United States Patent [19]

Johnson

[11] 4,114,516

[45] Sep. 19, 1978

[54] ANTI-CAVITATION AND PRESSURE MODULATING RELIEF VALVE FOR CONTROLLING HYDRAULIC CYLINDERS

[75] Inventor: Howard L. Johnson, Joliet, Ill.

[73] Assignee: Caterpillar Tractor Co., Peoria, Ill.

[21] Appl. No.: 732,558

[22] Filed: Oct. 15, 1976

[51] Int. Cl.[2] ..... F15B 11/08; F15B 13/02

[52] U.S. Cl. ..... 91/420; 91/453; 137/106

[58] Field of Search ..... 91/420, 453, 367, 452; 137/106

[56] References Cited

U.S. PATENT DOCUMENTS

| | | | |
|---|---|---|---|
| 2,483,312 | 9/1949 | Clay | 137/106 |
| 2,756,724 | 7/1956 | Stewart et al. | 91/420 |
| 3,181,430 | 5/1965 | Freedy et al. | 91/413 |
| 3,213,874 | 10/1965 | Schmiel et al. | 91/420 |
| 3,250,185 | 5/1966 | Tennis et al. | 91/420 |
| 3,266,381 | 8/1966 | Rohde | 91/420 |
| 3,423,136 | 1/1969 | Lohbauer | 137/625.3 X |
| 3,507,298 | 4/1970 | Ratliff | 137/106 |
| 3,817,154 | 6/1974 | Martin | 91/420 |
| 3,857,404 | 12/1974 | Johnson | 91/420 X |
| 3,967,532 | 7/1976 | Kokaly | 91/420 |

FOREIGN PATENT DOCUMENTS

| | | | |
|---|---|---|---|
| 2,011,996 | 10/1971 | Fed. Rep. of Germany | 91/420 |
| 84,323 | 1/1957 | Netherlands | 91/420 |

*Primary Examiner*—Irwin C. Cohen

*Attorney, Agent, or Firm*—Phillips, Moore, Weissenberger, Lempio & Majestic

[57] ABSTRACT

A construction vehicle has a work implement, such as a bucket-carrying boom, pivotally mounted thereon to be raised and lowered by one or more double-acting hydraulic cylinders. A directional control valve is conditioned to selectively communicate pressurized fluid to the rod end of each cylinder, for example, through a check valve. When the fluid pressure in the rod end of the cylinder exceeds a predetermined level, a pilot signal will be communicated to a modulating valve which will open to closely control and modulate the flow of the fluid exhausted from the head end of the cylinder. A pilot relief valve is interconnected between the head end of the cylinder and the modulating valve to cooperate therewith to relieve excessive fluid pressures. The above system is duplicated for selectively pressurizing the head end of the cylinder and for exhausting the rod end thereof.

13 Claims, 5 Drawing Figures

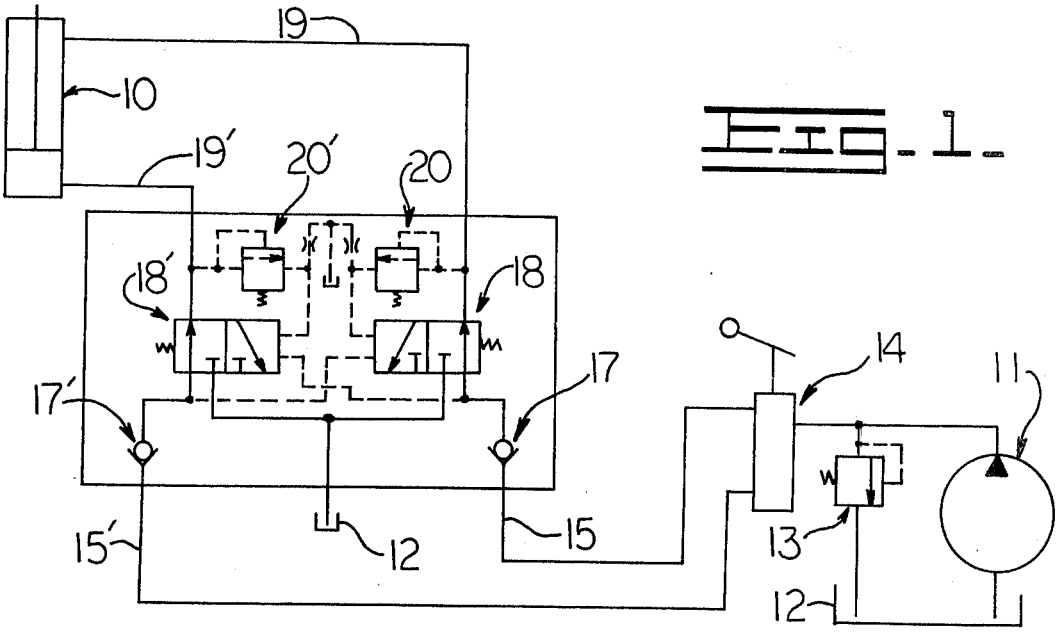
Fig. 1.
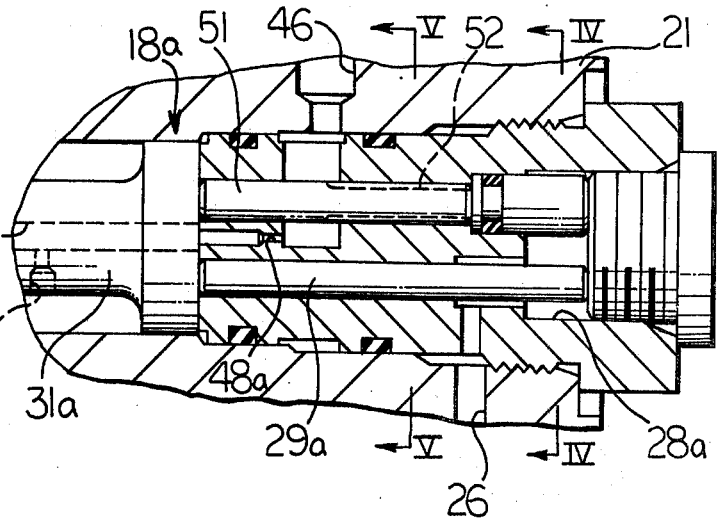
Fig. 3.
Fig. 4.
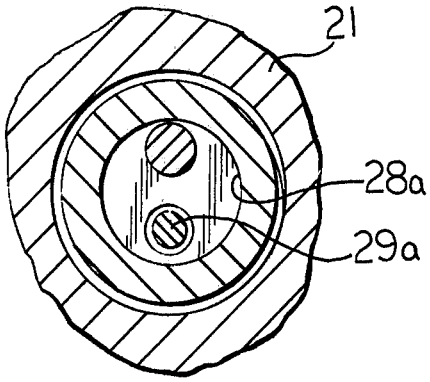
Fig. 5.
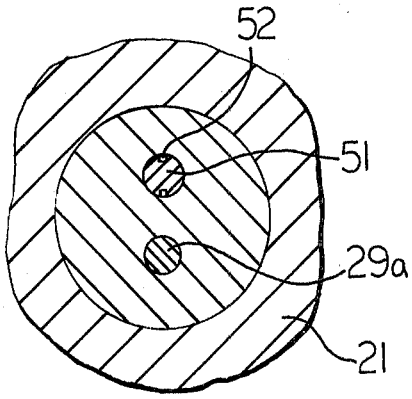

ANTI-CAVITATION AND PRESSURE MODULATING RELIEF VALVE FOR CONTROLLING HYDRAULIC CYLINDERS

BACKGROUND OF THE INVENTION

Construction vehicles, such as hydraulic excavators, normally employ a plurality of double-acting hydraulic cylinders thereon to selectively actuate various implements thereof. For example, such a cylinder is normally pivotally interconnected between a frame of the excavator and a boom thereof, pivotally mounted on the frame, to selectively raise or lower the boom relative to ground level. Upon lowering of the boom, for example, it is desirable to prevent such lowering at too rapid a pace and to further prevent any cavitation in the cylinder.

SUMMARY OF THIS INVENTION

This invention relates to a control circuit, including a double-acting cylinder, for closely controlling actuation of the cylinder in either direction and to further prevent cavitation thereof. A directional control valve is connected between a pressurized fluid source and the cylinder to selectively communicate pressurized fluid to the rod end thereof, for example. A modulating valve is directly responsive to pressurized fluid communicated to the rod end of the cylinder exceeding a predetermined level for simultaneously modulating exhaust of fluid from the head end of the cylinder to a reservoir directly upon such selective actuation of the directional control valve.

In the preferred embodiment of this invention, a check valve is interconnected between the pressurized fluid source and the rod end of the cylinder and a pilot relief valve is interconnected between the head end of the cylinder and the modulating valve for relieving excessive pressures in the head end of the cylinder. The above system is duplicated in the circuit for purposes of pressurizing the head end of the cylinder means and for exhausting the rod end thereof.

BRIEF DESCRIPTION OF THE DRAWINGS

Other objects of this invention will become apparent from the following description and accompanying drawings wherein:

FIG. 1 schematically illustrates a hydraulic control circuit for selectively extending or retracting a double-acting hydraulic cylinder employed therein;

FIG. 3 is a sectional view illustrating a modification of a modulating valve employed in the control circuit; and FIGS. 4 and 5 are sectional views taken in the direction of arrows IV—IV and V—V in FIG. 3, respectively.

GENERAL DESCRIPTION

Figure 2:
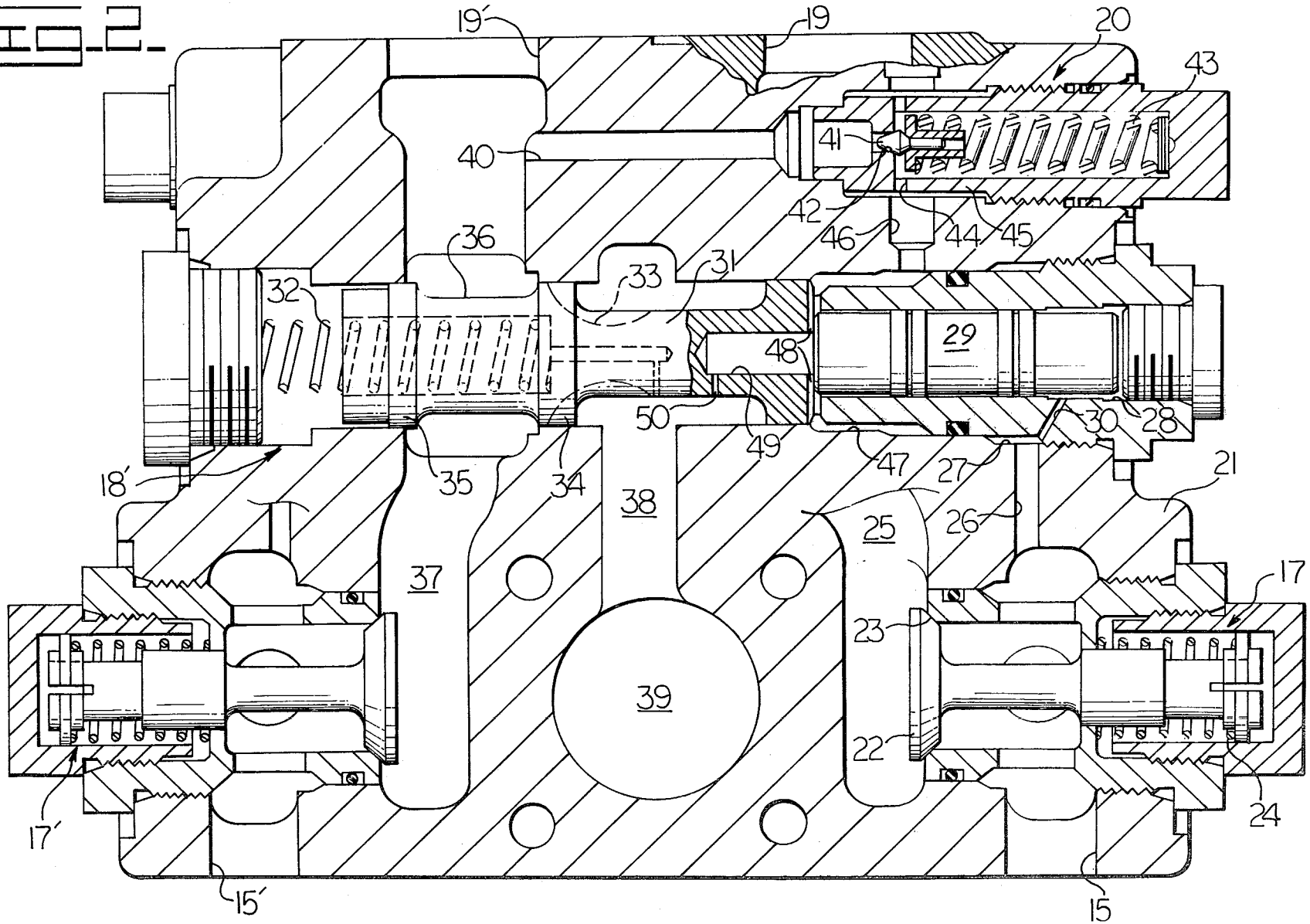
FIG. 2 is a sectional view of a bank of valves employed in the control circuit.

FIG. 1 illustrates a hydraulic control circuit adapted to selectively actuate a double-acting hydraulic cylinder 10. The cylinder may be of the type employed on a construction vehicle to selectively move an implement thereof during a construction operation. For example, the cylinder could be pivotally interconnected between a frame and a bucket-carrying boom of a hydraulic excavator to selectively raise or lower the boom relative to ground level.

The hydraulic control circuit comprises a pressurized fluid source, including a pump 11 and a reservoir 12. A standard relief valve 13 is suitably integrated into the circuit to relieve excessive pump pressures in a conventional manner. A standard directional control valve means 14 is interconnected between the fluid source and cylinder 10 to communicate pressurized fluid directly to the rod or head end of the cylinder via inlet lines 15 or 15', respectively.

Upon communication of pressurized fluid to the rod end of the cylinder,, for example, such fluid will pass through a check valve 17 and through a first modulating valve 18 wherefrom it communicates with the cylinder via a line 19. Simultaneously therewith, a second modulating valve 18', identical in makeup to valve 18, will open in direct response to pressurized fluid communicated to the rod end of the cylinder means exceeding a predetermined level to exhaust fluid from the head end of the cylinder to reservoir 12 directly. Should the level of fluid pressure in the head end of the cylinder become excessive, a first pilot relief valve 20' will cooperate with modulating valve 18' to relieve such excessive fluid pressure to reservoir 12, as hereinafter more fully explained.

When directional control valve 14 is actuated to communicate pressurized fluid to the head end of cylinder 10, the above general operation is substantially repeated with identical valve arrangements. In particular, the pressurized fluid will be communicated to the head end of the cylinder via a second check valve 17', second modulating valve 18' and conduit 19'. Fluid exhausted from the rod end of cylinder 10 will communicate to reservoir 12 directly through modulating valve 18 in response to pressurized fluid in the head end of the cylinder means exceeding a predetermined level.

From the above description it can be seen that duplicate systems are employed for effecting both the extension and retraction of the cylinder. However, in certain applications it may prove desirable to employ a single-acting cylinder and thus only one-half of the fluid circuit illustrated in FIG. 1. In such an application pressurized fluid could be utilized to move the cylinder in one direction to move it in the opposite direction.

DETAILED DESCRIPTION OF VALVING ARRANGEMENTS

FIG. 2 illustrates the structural details of valves 17, 17', 18' and 20. Since valves 18 and 20' are duplicates of valve 18' and 20 respectively, structural details of the former two valves have been omitted.

Referring to FIG. 2, all of the valves are mounted in a valve body or housing 21 defining the communicating ports to lines 15, 15', 19 and 19' therein. Each cartridge-type check valve 17 and 17' comprises a valve member 22 normally biased to a closed position on a seat 23 by a compression coil spring 24 to close communication between inlet line 15 and an outlet passage 25, communicating with modulating valve 18 (not shown in FIG. 2, but shown in FIG. 1). A passage 26 is also defined in the housing for communicating pressurized fluid to an annular chamber 27 when directional control valve 14 is actuated to communicate pressurized fluid to the rod end of cylinder 10.

Chamber 27, in turn, communicates with a control or pilot chamber 28, defined in the housing at one end of a generally cylindrical slug 29 of pressure modulating relief valve 18', via a passage 30. Upon pressurization of chamber 28, the opposite end of the slug will engage and move a spool 31 leftwardly in FIG. 2 against the opposed biasing force of a compression coil spring 32. The spring normally closes-off a plurality of metering slots 33 formed on the periphery of the spool. The slots each intersect an annular land 34 of the spool which cooperates with an axially spaced land 35 to form an annulus 36 for aiding in the communication of a passage 37 with line 19' when check valve 17' opens.

Housing 21 further defines a passage 38 therein which communicates with an open port 39 which, in turn, communicates with reservoir 12. Line 19' further communicates with a passage 40 which is adapted to communicate pressurized fluid from the head end of cylinder 10 to pilot relief valve 20. The pilot relief valve comprises a poppet 41 normally biased to a closed position on a seat 42 by a compression coil spring 43. Upon opening of the poppet, fluid will flow through a plurality of radial ports 44, formed in a tubular member 45 of the cartridge-type pilot relief valve. Ports 44 communicate with a passage 46, an annular chamber 47, slots 48 formed on the end of spool 31, a bore 49 formed in the spool, an orifice 50 and thence with exhaust passage 38.

FIGS. 3–5 illustrate a modification of the slug-end of each modulating valve 18 and 18' wherein corresponding structures are depicted by identical numerals, but with modified constructions being accompanied by an "*a*". A pair of separate slugs **29*a* and 51 are disposed between the end of a spool 31*a* and housing 21. The right end of first slug 29*a* is exposed to pressurized fluid communicated to an actuating chamber 28*a* via passage 26. Second slug 51 has a plurality of longitudinal slots 52 formed thereon to communicate passage 46 with the right end of the slug. Passage 46 further communicates with reservoir 12 via a restricted passage or orifice 48*a*, a passage 49*a* and a passage 50*a***.

DETAILED DESCRIPTION OF CONTROL CIRCUIT OPERATION RETRACTION OF CYLINDER 10

When the hydraulic control circuit is conditioned as illustrated in FIGS. 1 and 2, the operator may retract cylinder 10 by communicating pressurized fluid to the rod end thereof upon selective actuation of directional control valve 14. Referring to FIG. 2, the fluid will communicate to check valve 17 via inlet line 15 to move valve member 22 leftwardly, off seat 23, whereby the fluid will flow to the cylinder via passage 25 and line 19. When the fluid pressure in the rod end of the cylinder builds-up to a predetermined level, such pressure will be communicated to actuating chamber 28 via passage 26, chamber 27 and passage 30.

When the fluid pressure exceeds a predetermined level to counteract the biasing force of spring 32, slug 29 will move leftwardly to, in turn, move spool 31 leftwardly to open and expose slots 33 to fluid pressure in line 19'. Fluid from the head end of cylinder 10 is thus exhausted to reservoir 12 via line 19', slots 33, passage 38 and port 39. Should a sudden pressure drop occur in the rod end of the cylinder during retraction thereof, the pressure in chamber 28 would likewise drop to permit spring 32 to move spool 31 rightwardly to again close slots 33 to thus prevent further retraction of the cylinder. However, during a normal power-up or power-down mode of cylinder operation, the valve spool would be in an intermediate and modulating position for exhausting the head end of the cylinder and to maintain the predetermined pressure level in chamber 28 to maintain the spool and slots 33 in their open position.

In the event spool 31 is in its closed position illustrated in FIG. 2 and the fluid pressure in the head end of cylinder 10 becomes excessive, such fluid pressure will communicate to pilot relief valve 20 via passage 40. When the force of such fluid pressure exceeds the counteracting force of spring 43, poppet 41 will open to expose the righthand end of spool 31 to a low fluid pressure which is determined by outlet flow from pilot relief valve 20 passing through orifice 50. It is to be noted that the pressure created in chamber 47 is independent of the pressure in passage 40, except for the flow caused through orifice 50. Leftward movement of the spool will thus uncover slots 33 to communicate line 19' with reservoir 12, via passage 38 and exhaust port 39.

The fluid trapped behind spool 31 will communicate to reservoir 12 via ports 44, passage 46, chamber 47, slots 48, passage 49, orifice 50 and passage 38. Pilot relief valve 20, in its cooperation with modulating valve 18', thus comprises a pilot-operated relief valve arrangement for relieving excessive fluid pressures in the head end of the cylinder, both during retraction and extension thereof. Upon suitable relief of the fluid pressure in the head end of the cylinder, spring 43 will again bias poppet 41 into its closed position on seat 42 and spool 31 will move rightwardly to recover slots 31. It should be noted that disposition of orifice 50 downstream of the pilot relief valve will permit the ends of the modulating valve to be essentially at tank pressure to permit more than one signal to operate the modulating valve.

EXTENSION OF CYLINDER 10

When the operator desires to extend cylinder 10, the above operation is substantially repeated with duplicates 17', 18 and 20' of the above-described valving arrangements. In particular, suitable manipulation of directional control valve 14 will communicate pressurized fluid to check valve 17' via inlet line 15'. The check valve will open to thus communicate pressurized fluid to the head end of cylinder 10 via passage 37 and line 19'.

Simultaneously therewith, the fluid pressure prevalent in the head end of the cylinder will be communicated as a pilot signal to chamber 28' of modulating valve 18 (FIG. 1) to move spool 31' thereof to unmask and expose slots 33' to line 19 to modulate the exhaust of the rod end of the cylinder. Pilot relief valve 20' will function in the same manner as described above regarding the operation of its counterpart pilot valve 20.

Referring again to FIGS. 3–5, the piloting and relief functions of each modified modulating valve 18 and 18' will be similar to that described above. However, during the piloting function, piloting pressure communicated to actuating chamber **28*a* will not act on spool 31*a* directly, but will first act on the righthand end of rod 29*a* which, in turn, will function to move the spool leftwardly to unmask slots 33. During the relief function, wherein pilot relief valve 20 or 20' becomes operative, low fluid pressure will be communicated to the righthand end of rod 51, via passage 46 and slots 52, to move the slug and spool 31*a* leftwardly to unmask slots 33 to exhaust fluid from a respective end of the cylinder. The fluid trapped behind rod 51 and spool 31*a* will communicate to reservoir 12 via orifice 48*a*, passage 49*a* and port 50*a* to reduce the pressure thereof whereby poppet 41 (FIG. 2) will again seat and the spool will move rightwardly to cover slots 33** to resume normal cylinder operation.

What is claimed is:

1. A control circuit comprising a double-acting cylinder means having a rod end and a head end, a pressurized fluid source, including a reservoir, directional control valve means connected between said fluid source and said cylinder means for communicating pressurized fluid to one of the rod and head ends of said cylinder means upon selective actuation of said directional control valve means, modulating valve means directly responsive to pressurized fluid communicated to said cylinder means exceeding a predetermined level for simultaneously modulating exhaust of fluid from the other one of the rod and head ends of said cylinder means to said reservoir directly upon said selective actuation of said directional control valve means, said modulating valve means comprising a spool reciprocally mounted in a housing and having a plurality of normally closed metering slots formed thereon and adapted to open upon movement of said spool for modulating exhaust of fluid from said other one of the rod and head ends of said cylinder means to said reservoir, check valve means connected between said pressurized fluid source and said cylinder means for communicating pressurized fluid to one of the rod and head ends of said cylinder means and for preventing fluid flow thereby upon exhaust of the other one of the rod and head ends of said cylinder means, and means responsive to fluid pressure in said cylinder means including pilot relief valve means interconnected between said directional control valve means and said other one of the rod and head ends of said cylinder means and opening to permit fluid flow to act on said modulating valve means for moving said spool to open said slots for exhausting fluid pressure from said cylinder means and to said reservoir when such fluid pressure exceeds a predetermined level.

2. The control circuit of claim 1 wherein said check valve means is interconnected between said pressurized fluid source and said modulating valve means.

3. The control circuit of claim 1 wherein said modulating valve means further comprises a slug reciprocally mounted in said housing to have a first end thereof engage an end of said spool and control chamber means defined between a second end of said slug and said housing for communicating with the end of said cylinder means having said pressurized fluid communicated thereto to move said spool to at least partially open said slots.

4. The control circuit of claim 1 wherein said modulating valve means further comprises spring means mounted between said housing and said spool for normally moving said spool to a closed position covering said slots.

5. The control circuit of claim 4 wherein said modulating valve means further comprises a slug reciprocally mounted in said housing to normally engage an end of said spool remote and opposite to the end of said spool engaged by said spring and means defining an actuating chamber between an end of said slug, opposite to the end engaging said spool, for receiving said pressurized fluid from said cylinder means which exceeds a predetermined level for moving said slug into engagement with said spool to move said spool to uncover said slots to exhaust fluid from said other one of the rod and head ends of said cylinder means to said reservoir.

6. The control circuit of claim 1 wherein said pilot relief valve means comprises a poppet reciprocally mounted in said housing and spring means disposed between said housing and said poppet for normally biasing said poppet in a closed position on a seat defined in said housing.

7. The control circuit of claim 1 further comprising passage means formed in said housing and orifice means disposed downstream of said pilot relief valve and between said pilot relief valve and said reservoir for communicating fluid from said pilot relief valve means to said reservoir upon opening of said pilot valve means.

8. The control circuit of claim 7 wherein said passage means comprises slots formed on an end of said spool and a passage formed in said spool and wherein said orifice means comprises at least one orifice formed in said spool and communicating said passage with said reservoir.

9. The control circuit of claim 7 wherein said orifice means comprises an orifice formed in said housing and said passage means comprises a passage formed in said spool which, in turn, communicates with said reservoir and further comprising a slug reciprocally mounted in said housing and having a first end thereof engaging said spool and slot means communicating said pilot valve means with a second end of said slug.

10. The control circuit of claim 1 wherein a pair of said modulating valve means are each interconnected between a respective one of the rod and head ends of said cylinder and said pressurized fluid source.

11. The control circuit of claim 10 further comprising a pair of check valve means each interconnected between a respective one of the rod and head ends of said cylinder and said pressurized fluid source for communicating pressurized fluid to such respective one of the rod and head ends of said cylinder means and for preventing return flow of fluid from the other one of the rod and head ends of said cylinder means.

12. The control circuit of claim 10 further comprising a pair of means responsive to fluid pressure in said cylinder means, including pilot relief valve means, each interconnected between a respective one of the rod and head ends of said cylinder means and a respective one of said modulating valve means for exhausting excessive pressure in such respective one of the rod and head ends of said cylinder means.

13. A control circuit comprising a double-acting cylinder means having a rod end and a head end, a pressurized fluid source, including a reservoir, directional control valve means connected between said fluid source and said cylinder means for communicating pressurized fluid to one of the rod and head ends of said cylinder means upon selective actuation of said directional control valve means, modulating valve means directly responsive to pressurized fluid communicated to said cylinder means exceeding a predetermined level for simultaneously modulating exhaust of fluid from the other one of the rod and head ends of said cylinder means to said reservoir directly upon said selective actuation of said directional control valve means, said modulating valve means comprising a member reciprocally mounted in a housing and adapted to open upon movement of said member for modulating exhaust of fluid from said other one of the rod and head ends of said cylinder means to said reservoir, means connected between said pressurized fluid source and said cylinder means for communicating pressurized fluid to one of the rod and head ends of said cylinder means and for preventing fluid flow thereby upon exhaust of the other one of the rod and head ends of said cylinder means, and means responsive to fluid pressure in said cylinder means including pilot relief valve means interconnected between said directional control valve means and said other one of the rod and head ends of said cylinder means and opening to permit fluid flow to act on said modulated valve means for moving said member for exhausting fluid pressure from said cylinder means and to said reservoir when such fluid pressure exceeds a predetermined level.

* * * * *